United States Patent [19]

Wege

[11] 4,392,426

[45] Jul. 12, 1983

[54] INK-APPLYING ARRANGEMENT

[75] Inventor: Regina Wege, Leipzig, German Democratic Rep.

[73] Assignee: Veb Kombinat Polygraph "Werner Lamberz" Leipzig, Leipzig, German Democratic Rep.

[21] Appl. No.: 249,176

[22] Filed: Mar. 30, 1981

[30] Foreign Application Priority Data

Apr. 15, 1980 [DD] German Democratic Rep. ... 220444

[51] Int. Cl.[3] ..... B41F 31/04; B41F 31/06; B41F 31/08

[52] U.S. Cl. ..... 101/363; 101/365

[58] Field of Search ..... 101/365, 363, 364, 350, 101/207, 208, 209, 210, 366; 118/259, 261, 267, 212

[56] References Cited

U.S. PATENT DOCUMENTS

| | | | |
|---|---|---|---|
| 512,562 | 1/1894 | Moore | 101/365 X |
| 2,762,301 | 9/1956 | Cornell | 101/365 |
| 2,887,044 | 5/1959 | Smejda | 101/207 X |
| 2,945,437 | 7/1960 | Hilgoe et al. | 101/350 |
| 4,158,333 | 6/1979 | Navi | 101/363 |

FOREIGN PATENT DOCUMENTS

| | | | |
|---|---|---|---|
| 869690 | 2/1942 | France | 101/365 |

*Primary Examiner*—J. Reed Fisher
*Attorney, Agent, or Firm*—Michael J. Striker

[57] ABSTRACT

An ink-applying device having a funnel-shaped ink reservoir filled with ink is provided with an ink pick-up roller positioned below the ink reservoir and in communication therewith. A number of dosing chambers of differing diameters are formed in the circumferential surface of the roller to receive ink from the ink reservoir and to transmit it to an ink-transmitting roller upon rotation of the pick-up roller. The ink dosing chamber may be selectively closed after they have been filled with ink, in any required combination by a number of sliders or plungers adapted to move between a closing and opening positions and controlled by electromagnets or any suitable electronic device.

13 Claims, 8 Drawing Figures

INK-APPLYING ARRANGEMENT

BACKGROUND OF THE INVENTION

The present invention relates generally to a printing machine, and more particularly to an arrangement for applying ink to a pick-up roller in an ink-applying apparatus.

It is known that the thickness of the ink layer discharged from the ink reservoir must be adjusted so that ink to be applied is dosed to a predetermined value. In the known so-called wedge-type ink-applying arrangements the adjustment of the thickness of the ink layer is carried out by adjusting of the position of a doctor blade relative to the circumferential surface of the pick-up roller. The doctor blade in such arrangements is pressed against the pick-up roller by screw-setting devices whereby a gap between the roller and the doctor blade is changed. In such arrangements the individual color zones formed along the width of the ink reservoir in the region of the aforementioned gap are adjusted to a differing degree so that due to differing pressures on the doctor blade along the entire width of the reservoir a uniform ink profile can not be obtained.

Because the doctor blade is elastic and the neighboring color zones are differently adjusted by the screw devices and thus have a differing thickness they affect each other which also leads to the uneven ink layer along the width of the reservoir.

Arrangements for relatively accurate adjustment of ink layer in the ink-applying devices have been already suggested where dosing and supply of ink were controlled by pumps. Such construction is disclosed, for example in the Swisss Pat. No. 392565. In the disclosed construction a plurality of pumps are mounted along the width of the ink reservoir which supply ink to respective friction rollers. It should be noted that with relatively high expenses, the satisfactory dosing of ink at individual color zones connected to respective sprinkling nozzles may be obtained. However, it should be recognized that the necessity of periodical changes and subsequent cleaning of all ink pumps, conduits and nozzles are considerably troublesome and lead to high expenses in utilization of the known device. Furthermore, it is to be understood that in the known devices an individual drive is required for each discrete color zone and each individual nozzle outlet must be adjusted to a predetermined value in order to avoid changes in the ink profile. For these reasons, pumps, brushing devices, and centrifugal devices have not found general acceptance.

In order to overcome the problems experienced in the ink-applying arrangements it has been suggested to further improve ink dosing by changing nozzles in the ink reservoir. Such proposal is disclosed, for example, in the German Pat. No. 2,553,177.

The Swiss Pat. No. 591,119 discloses another modification of the ink-applying device where a slotted doctor blade is suggested which is formed with a plurality of neighboring portions operating independently from each other.

In the device described for example in the U.S. Pat. Nos. 1,275,348 and 1,574,474, the doctor blade is formed of a plurality of descrete adjustable sliders. Such sliders disclosed, for example in the U.S. Pat. No. 3,978,788 are adjacently positioned along the whole width of the ink reservoir so that alltogether they form the doctor blade. In order to change the position of the doctor blade each slider is provided with an electromotor coupled with a transmission and an eccentric device cooperated with the slider. In such a construction all inaccuracies occured during the adjustment of the discrete sliders directly affect the ink layer to be dosed causing its deflection from a predetermined value. Moreover, due to the reduction of number of revolutions of electromotors required for operation of the eccentric devices a preliminary designed and calculated gap between the pick-up roller and the doctor blade should be further adjusted.

All this leads to a fact that the extremely accurate adjustment of the ink gaps in the ink-applying devices involves very high expenses since the once adjusted gap should be monitored and then readjusted again for a certain value of accuracy required in each individual case.

The U.S. Pat. No. 3,730,089 suggests to utilize a funnel-shaped ink reservoir instead of the wedge-type ink container. The ink within the reservoir is monitored by forming it into a vortex and then monitoring a radial dimension of the vortex. In such devices the doctor blade is formed by at least one of the longitudinal walls of the ink reservoir.

SUMMARY OF THE INVENTION

It is an object of the invention to provide a device which overcomes the disadvantage of the prior art arrangements.

Another object of the invention is to provide an improved ink applicator which ensures an adequately adjusted ink profile on a predetermined value along the entire width of the ink reservoir.

Still another object of the invention is to provide an ink applicator which ensures an extremely accurate predetermined ink dosing within a relatively large range of adjustment of the ink layer.

A further object of the invention is to provide a remote control of the aforementioned adjustment. Yet another object of the invention is to exclude the mutual influence of adjacent color zones on each other.

The ink applicator of the invention renders it possible to provide a constant manual remote control for further adjustment of the ink layer to be applied to a pick-up roller.

These and other objects of the invention are attained by an ink-applying device, particularly for a printing machine, comprising a funnel-shaped ink reservoir having at least one opening through which ink is discharged; a rotary pick-up roller positioned in the proximity of said opening to receive ink therefrom, said pick-up roller including at least one longitudinally extending row of ink dosing chambers formed in a circumferential surface thereof; and movable means adapted to close or open communication between said at least one opening and at least some of said chambers to provide a required dosing of ink received by said roller.

The movable means may include a plurality of sliding members adapted to slide along the circumferential surface of the roller.

The funnel-shaped reservoir may have a wall formed with a doctor blade in the region of said opening, the sliding members being adapted to slide toward and from the doctor blade.

The sliding members may have a differing width.

The doctor blade may be flexible and have an end portion abutting against the pick-up roller.

The ink dosing chambers may have differing diameters.

The sliding members may be provided with actuating means which may include a plurality of electromagnets and a plurality of levers interconnected between the electromagnets and the respective sliding members.

The ink reservoir may include a bottom wall, a plurality of openings being formed in said bottom wall, said openings being positioned above the respective ink dosing chambers. These openings may have a conical shape.

The movable means may include a plurality of vertically swingable plungers adapted to close or open at least some of the openings in the bottom wall.

The device may include a plurality of controlling pins situated in said ink dosing chambers and movable therein to define a volume of said chambers for receiving ink from said reservoir or for pulling ink outward of the ink dosing chambers for discharging ink to a site of ink application.

The device may also include two rows of the ink dosing chambers, said two rows being diametrically oppositely positioned on the circumferential surface of the pick-up roller.

The essential advantage of the ink-applying device according to the invention is that the ink dosing is affected by sliding members or plungers which are moved only in a predetermined end position. The dosing is carried out by mere selection of certain sliding members of the required width or of certain dosing chambers of the required diameters within each color zone. In the ink-dosing arrangement of the invention, an extremely accurate ink dosing may be obtained. For example, in one color zone having three dosing chambers of differing diameters only one chamber with a smallest diameter may be opened whereas two other dosing chambers may be closed with the corresponding sliding members or plungers. In some arrangements, dosing chambers of a medium size or a relatively large size may be employed so that any possible combination of dosing chambers in a row or in a number of rows may be provided in each color zone. Further possibilities of improvement of the proposed ink dosing arrangement lie in that the dosing roller may be driven with different velocities. Alternatively, the dosing roller may be driven by a maltese cross device so that the dosing chambers will be filled with ink periodically when the dosing roller is in a still-stand position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
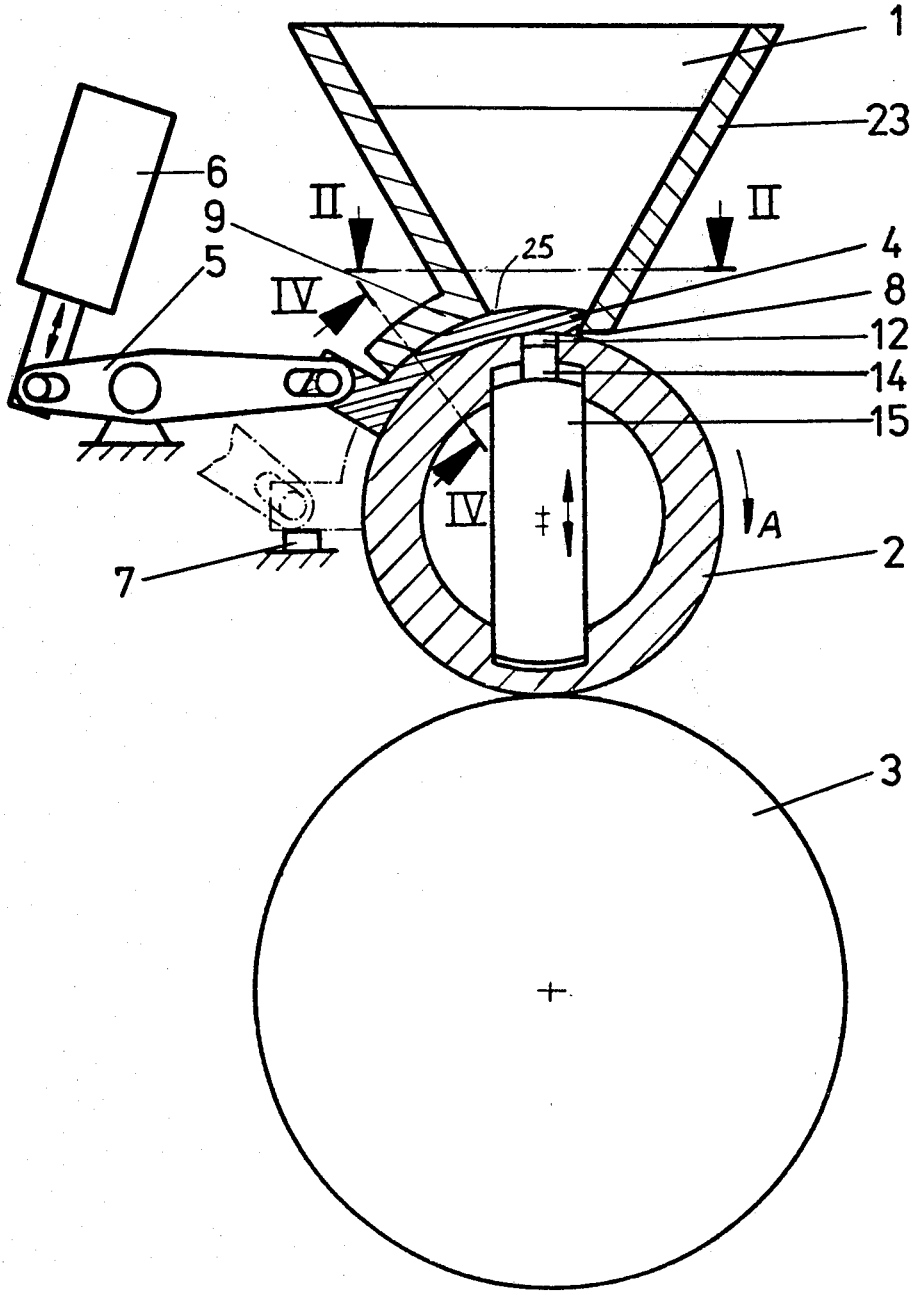
FIG. 1 is a schematic view, partially in section of an ink applicator showing a closed ink reservoir.
Figure 4:
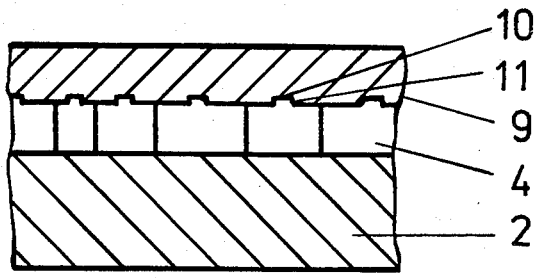
FIG. 4 is a partial sectional view along line IV—IV of FIG. 1.

Referring to the drawings, and first to FIG. 1, an ink applicator for a printing press includes a continuously driven rotary dosing or pick-up roller 2 arranged under an ink reservoir 1 filled with ink or any other suitable liquid. The dosing roller 2 is arranged in communication with a rotary ink-transmitting roller 3 which in turn cooperates with a number of ink-application rollers in a manner known in the art and not shown for the sake of simplicity. A number of sliding members 4 are slidably mounted between the reservoir 1 and the dosing roller 2 and extend over the entire width of the outlet opening 25 of the ink reservoir 1 as shown in FIG. 4. The sliding members 4 are of differing width and positioned on the dosing roller 2 tightly adjacent to each other. Each sliding member 4 is provided with a positioning device. This device includes a double lever 5 actuated by an electro-magnet 6 or any suitable electronic control device. In operation, a respective sliding member 4 slides in a circumferential direction back and forth between a closed position when the front end of the slider is in contact with a doctor blade 8 and an open position when the rear end of the slider abuts against a stop 7. The flexible doctor blade 8 is in the foregoing device a portion of one side wall 23 of the ink reservoir 1 whereas the other side wall of the reservoir is formed with a shank or projection 9 abuting against the upper surfaces of the sliding members 4 in their swingable movement.

For guiding of the sliding members 4 along the shank 9 the latter is provided with a plurality of guiding grooves 10 in which webs 11 of the sliding members 4 are slidably moved.

Figure 2:
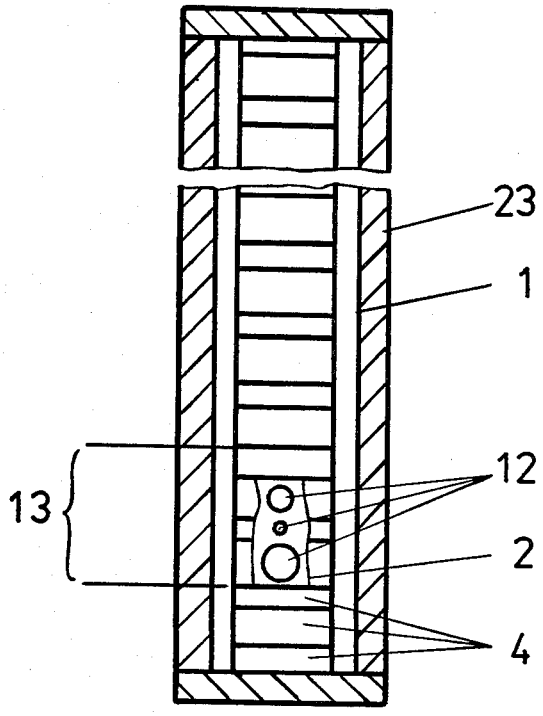
FIG. 2 is a sectional view along line II—II of FIG. 1.
Figure 5:
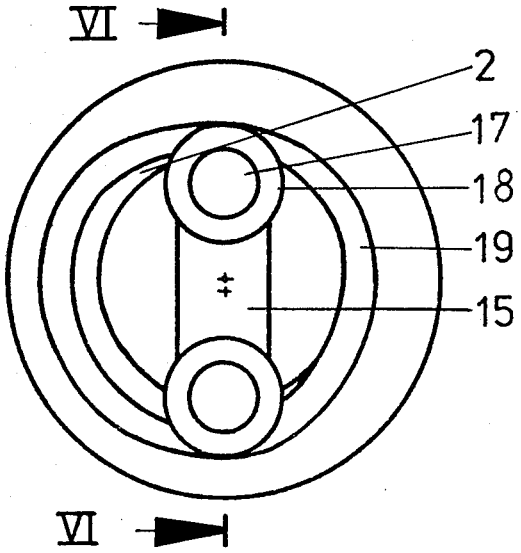
FIG. 5 is a view of a drive means in a dosing chamber with a plunger-like pin.

The dosing roller 2 is provided with a plurality of dosing chambers 12 of differing diameters positioned in a row. Each ink zone (as seen in FIG. 2) includes a number of various dosing chambers 12 and is enclosed with sliding members 4 of differing width. Each of the dosing chambers is provided with a pin 14; pins 14 of all the chambers 12 are rigidly mounted on a common bar 15. This bar extends at its one side through the pick-up roller 2 which is mounted in a machine wall 16 and carries axles 17 at its other side. A pair of cam rollers 18 are arranged on the respective axles 17, which rollers engage with an inner cammed surface of a cam 19 rigidly secured to the machine wall 16 so that bar 15 and pins 14 are controlled by cam 19 in the moving cycle of cam rollers 18 (FIG.5, 6).

Figure 3:
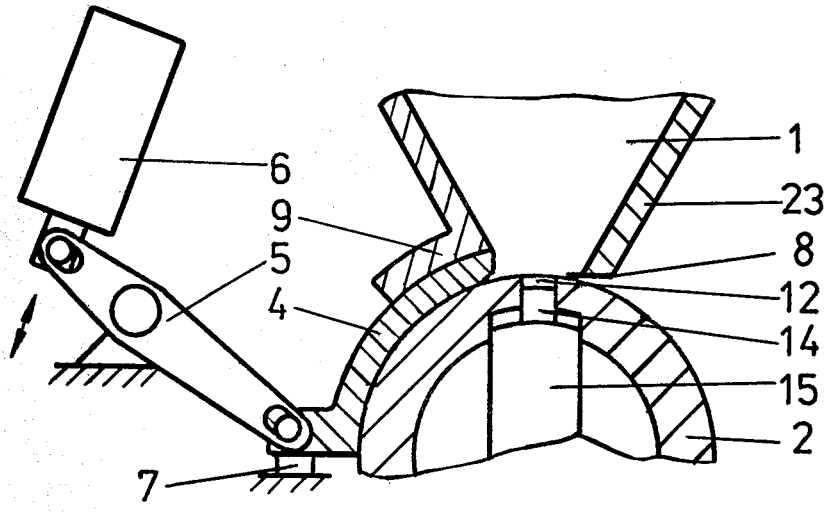
FIG. 3 is a partial view identical to FIG. 1, but showing an opened ink reservoir.

In operation, when the sliding members 4 open the reservoir lower opening (as shown in FIG. 3) the dosing chambers 12 are filled with ink. The position of the sliding members 4 may be changed manually or, as for example shown in the preferred embodiment, by a given program. Both fashions of operation of the sliding members 4 may be obtained if desired. Since each ink zone 13 includes several different dosing chambers 12 and thus receives a different volume of ink the ink application may be adjusted by selection of certain dosing chambers and may be changed by small steps from "zero" to any required maximum amount. The cam 19 is preferably so configurated that the pins 14 in the region of the sliding members 4 are pulled inwardly so that all the dosing chambers 12 which are not closed by members 4 receive ink from reservoir 1. Upon a further rotation of the roller 2 in a direction shown by arrow A the chambers 12 pass through the flexible doctor blade 8 and thus do not receive more ink from the reservoir 1. When the chambers 12 reach the position of contact with the ink-transmitting roller 3 pins 14 affected by the cam 19 and cam rollers 18 move in an outward direction so that ink is discharged from chambers 12 and transmitted to the roller 3. During a short contact of the pick-up roller 2 with the ink-transmitting roller 3 ink is completely separated from roller 2 by a mixer. The pins 14 are so arranged that after dosing chambers 12 pass the contact point with the roller 3 some amount of ink still remains in the chambers 12.

Figure 7:
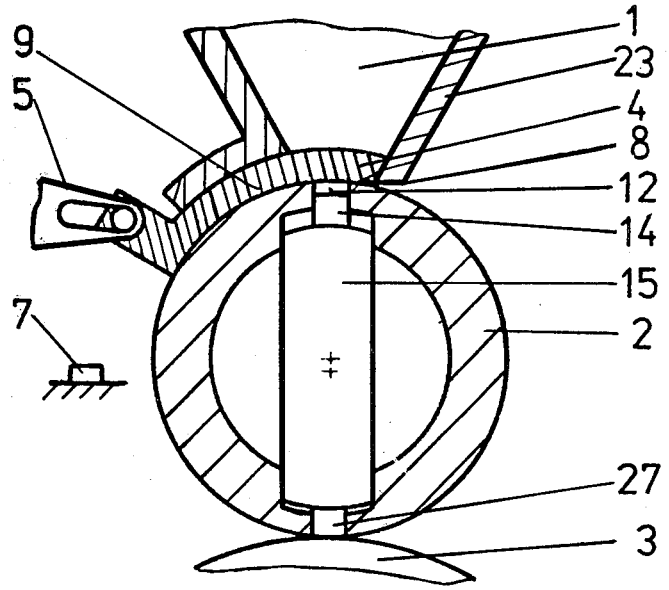
FIG. 7 is a view identical to FIG. 1, but with two opposite rows of dosing chambers.

In another embodiment shown in FIG. 7, a second row of dosing chambers 12 is provided situated diametrically opposite to the upper row of the chambers.

Figure 6:
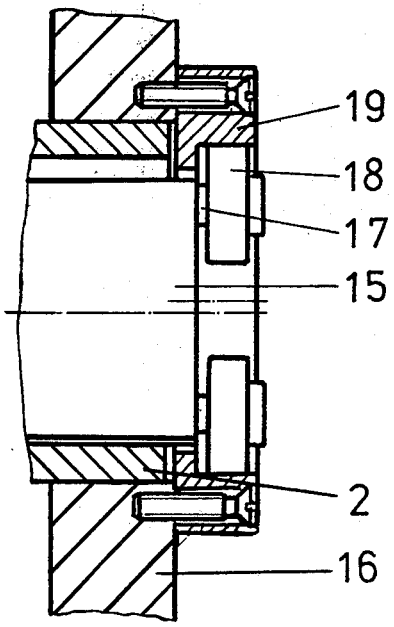
FIG. 6 is a sectional view along line VI—VI of FIG. 5.

The chambers 12 are arranged with respective pins identical to pins 14 shown in FIGS. 1 and 6 and with the corresponding cam 19.

Figure 8:
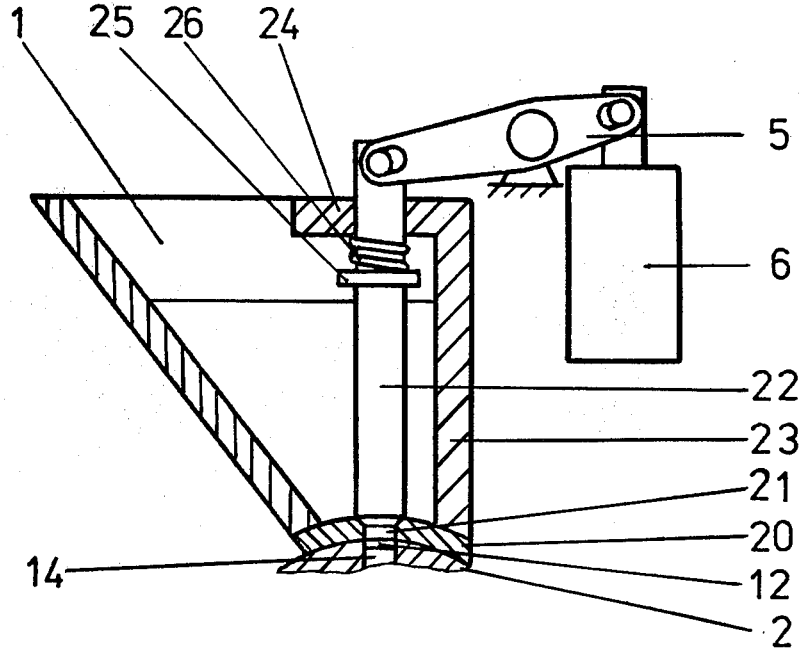
FIG. 8 is a further modification of the ink applicator according to the invention.

Still another embodiment of the invention is shown in FIG. 8. Instead of sliding members 4 the ink reservoir 1 is provided with a bottom wall 20 formed with a number of conical apertures 21 having substantially differing diameters corresponding to those of the dosing chambers 12. In each dosing aperture 21 a swingable plunger 22 is provided so that this plunger in a fashion similar to that for the sliding members 4 lowers and thus closes the dosing chambers 12 to prevent the flow of ink thereinto or lifts to permit the ink to flow into the dosing chambers 12.

The side wall 23 of the ink reservoir 1 is formed with a substantially rectangular upper projection 24 in which corresponding plungers 22 are mounted and guided in their swingable movement. This swingable movement is affected by the levers 5 and the electromagnets 6 which may be replaced by a suitable electronic control device. The plunger 22 is formed with a flange 25. A compression spring 26 is mounted on each plunger between the flange 25 and the projection 24. The positioning of the plunger 22 is performed in the same mode as the above described operation of the sliding members 4.

It may be advantageous in this embodiment to provide such arrangement that the dosing roller 2 does not continuously rotate and for this purpose it is provided, for example with a drive having a maltese cross so that the chambers 12 will not move in the position under the corresponding apertures 21 unless the adequate filling of chamber 12 will be ensured.

It will be understood that each of the elements described above, or two or more together, may also find a useful appliation in other types of ink-applying arrangements differing from the type described above.

While the invention has been illustrated and described as embodied in an ink-applying arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An ink-applying device, particularly for a printing machine, comprising a funnel-shaped ink reservoir having at least one opening through which ink is discharged and including a wall formed with a doctor blade in the region of said opening, a rotary pick-up roller positioned in the proximity of said opening to receive ink therefrom, said pick-up roller including at least one longitudinally extending row of ink dosing chambers formed in a circumferential surface thereof; and movable means, said movable means including a plurality of sliding members adapted to slide along said circumferential surface towards and from said doctor blade to close or open communication between said at least one opening and at least some of said chambers to provide a required dosing of ink received by said roller.

2. The device of claim 1, wherein said sliding members are adjacent one another and extend along the entire width of said reservoir in the region of said opening.

3. The device of claim 2, wherein said sliding members have a differing width.

4. The device of claim 3, wherein, said doctor blade is flexible and has an end portion abutting against said pick-up roller.

5. The device of claim 4, wherein said ink dosing chambers have a circumferential shape, some of said chambers in said row having differing diameters.

6. The device of claim 5, further including means for actuating said sliding members.

7. The device of claim 6, wherein said actuating means includes a plurality of electromagnets and a plurality of levers inter-connected between said electromagnets and the respective sliding members.

8. The device of claim 7, wherein said sliding members have a segment shape.

9. The device of claim 1, further including a plurality of controlling pins situated in said ink dosing chambers and movable therein to define a volume of said chambers for receiving ink from said reservoir or for pulling ink outward of said chambers for discharging ink to a site of ink application.

10. The device of claim 9, further including a bar operatively connected to said pick-up roller and adapted to support said controlling pins.

11. The device of claim 10, including means for controlling the movement of said controlling pins.

12. The device of claim 11, wherein said controlling means include a cam mounted on said pick-up roller and having a cam surface and cam followers mounted on said bar and adapted to engage with said cam surface.

13. The device of claim 1, including two rows of the ink dosing chambers, said two rows being diametrically oppositely positioned on said circumferential surface of said pick-up roller.

* * * * *